US008079590B2

(12) United States Patent
Murakami et al.

(10) Patent No.: US 8,079,590 B2
(45) Date of Patent: Dec. 20, 2011

(54) IMAGE FORMING APPARATUS

(75) Inventors: Reiji Murakami, Kanagawa (JP); Naofumi Soga, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 129 days.

(21) Appl. No.: 12/484,768

(22) Filed: Jun. 15, 2009

(65) Prior Publication Data

US 2009/0309297 A1 Dec. 17, 2009

Related U.S. Application Data

(60) Provisional application No. 61/073,011, filed on Jun. 16, 2008.

(51) Int. Cl.
*B65H 7/02* (2006.01)

(52) U.S. Cl. ..... 271/265.04; 271/262; 271/263; 271/258.05

(58) Field of Classification Search ..... 271/265.04, 271/258.05, 262, 263
See application file for complete search history.

(56) References Cited

U.S. PATENT DOCUMENTS

| | | | | |
|---|---|---|---|---|
| 5,029,837 | A * | 7/1991 | Uchiyama | 271/110 |
| 5,765,826 | A * | 6/1998 | Isoda et al. | 271/162 |
| 5,962,861 | A * | 10/1999 | Fowler | 250/559.27 |
| 6,000,693 | A * | 12/1999 | Tranquilla | 271/263 |
| 6,381,423 | B1 * | 4/2002 | Eom | 399/45 |
| 6,705,609 | B2 * | 3/2004 | Kim | 271/262 |
| 7,124,935 | B2 * | 10/2006 | Osawa et al. | 235/379 |
| 7,182,338 | B2 * | 2/2007 | Akaike | 271/265.04 |
| 2007/0018383 | A1 * | 1/2007 | Ohara et al. | 271/262 |
| 2009/0057995 | A1 * | 3/2009 | Murakami et al. | 271/262 |
| 2009/0074435 | A1 | 3/2009 | Murakami | |
| 2009/0074436 | A1 | 3/2009 | Murakami | |
| 2009/0136246 | A1 | 5/2009 | Murakami | |
| 2009/0243203 | A1 * | 10/2009 | Yokoyama et al. | 271/262 |
| 2010/0123280 | A1 * | 5/2010 | Miyazawa et al. | 271/3.09 |
| 2010/0301551 | A1 * | 12/2010 | Muranaka et al. | 271/265.04 |

FOREIGN PATENT DOCUMENTS

| | | |
|---|---|---|
| JP | 2003-149887 | 5/2003 |
| JP | 2003-237982 A | 8/2003 |
| JP | 2003-269904 | 9/2003 |

* cited by examiner

*Primary Examiner* — Kaitlin Joerger
*Assistant Examiner* — Prasad Gokhale
(74) *Attorney, Agent, or Firm* — Patterson & Sheridan, LLP

(57) ABSTRACT

An image forming apparatus of an embodiment of the invention includes a pair of conveyance rollers to nip and convey a sheet on which a formed image is recorded, a turning amount detection section which is disposed downstream of the pair of conveyance rollers and includes a bearing section coming in contact with the sheet, a thickness detection section to detect a thickness of the sheet based on a turning amount detected by the turning amount detection section, a pair of register rollers which is disposed downstream of the bearing section and aligns the sheet, and an image recording and fixing section to record and fix the image on the sheet passing through the pair of register rollers. A distance from a center point of a contact portion of the pair of conveyance rollers to a point where the bearing section contacts with the sheet is zero or more and about 3 mm or less.

19 Claims, 10 Drawing Sheets

IMAGE FORMING APPARATUS

CROSS-REFERENCE TO RELATED APPLICATION

The present invention is based upon the benefit of priority from U.S. Provisional Application No. 61/073,011 filed on Jun. 16, 2008. The contents of the provisional application are incorporated herein by reference.

TECHNICAL FIELD

The present invention relates to an image forming apparatus, and particularly to an image forming apparatus including a bearing section for measuring paper thickness.

BACKGROUND

Hitherto, in an image forming apparatus such as a multi-function color copier (MFP), the types of media on which color images or the like are printed are increased. Even if the print media are limited to sheets, various sheets different in thickness or the like are used.

Incidentally, the types of sheets are generally differentiated by basis weight (unit: $g/m^2$) indicating the weight per an area, and for example, sheets of groups of 64 to 105, 106 to 163, 164 to 209, 210 to 256, and 257 to 300 are respectively called standard paper, thick paper 1, thick paper 2, thick paper 3 and thick paper 4. These basis weights are generally written on packages of sheets. When the user selects one of the groups according to the written basis weight, a print condition corresponding to the type of the paper is automatically set. In general, it is desirable to change the print condition according to the basis weight. However, there is a case where the basis weight is unclear, and in such a case, it is difficult to simply detect the basis weight. The basis weight can be calculated from the density of the sheet and the paper thickness. Although it is difficult to measure the density of the sheet, it is relatively easy to measure the paper thickness as compared with the measurement of the density. Then, an apparatus is known which detects the paper thickness in order to find the paper type or the like.

There are various such paper thickness detecting apparatuses. JP-A-2003-237982 discloses a paper thickness detection apparatus in which a sheet is made to pass through between a rotating drive roller and a paper thickness roller, and the paper thickness is detected by using that the paper thickness roller shifts around an arm shaft at that time.

Besides, JP-A-2003-269904 discloses a paper thickness measuring apparatus in which a sheet is inserted and made to pass through between a fixed section (ferrite) made of a magnetic material and a rotation section, and the paper thickness is measured by using the amount of magnetic field change at the time of passing. The paper thickness measuring apparatus is provided at a halfway portion of a sheet conveyance path, and is disposed immediately after (downstream side in the paper conveyance direction) a nip of a paper conveyance unit including a conveyance roller 9*a* and a conveyance roller 9*b* (see paragraph [0016]).

After the paper thickness is measured by such a paper measuring apparatus, the sheet is conveyed to a register roller and the sheet is aligned.

When recording is performed continuously, in order to increase the number of copied sheets per unit time, it is desirable that the sheets are fed from the paper thickness detecting apparatus to the register roller without interruption and as continuously as possible.

The sheet is aligned by the register roller, and the skew of the sheet is removed. However, when the trailing edge and its vicinity of the sheet remains in the paper thickness detecting apparatus when the sheet is aligned, this portion slides in the lateral direction relative to the running direction of the sheet. At this time, when the paper thickness detecting apparatus is such an apparatus that the paper thickness is detected by the shift of an outer ring of a bearing section, friction occurs between the sheet and the outer ring by the sliding of the sheet in the lateral direction (thrust direction), and an abnormal sound may be generated.

SUMMARY

The present invention is made in view of the above, and provides an image forming apparatus including a mechanism which can prevent an abnormal sound from being generated by friction between a sheet and an outer ring of a bearing section when the mechanism using bearings is used as a paper thickness detecting apparatus.

According to an aspect of the invention, an image forming apparatus includes a pair of conveyance rollers to nip and convey a sheet on which a formed image is recorded, a turning amount detection section which is disposed downstream of the pair of conveyance rollers and includes a bearing section coming in contact with the sheet, a thickness detection section to detect a thickness of the sheet based on a turning amount detected by the turning amount detection section, a pair of register rollers which is disposed downstream of the bearing section and aligns the sheet, and an image recording and fixing section to record and fix the image on the sheet passing through the pair of register rollers, in which a distance from a center point of a contact portion of the pair of conveyance rollers to a point where the bearing section contacts with the sheet is zero or more and about 3 mm or less.

DETAILED DESCRIPTION

An image forming apparatus of an embodiment of the invention will be described with reference to the drawings. One of features of the embodiment of the invention described below is a positional relation between a pair of conveyance rollers which nips and conveys a sheet and a bearing section which is provided downstream thereof and is brought into contact with the sheet in order to measure the thickness of the sheet (see FIG. 6, FIG. 12 and FIG. 13).

The image forming apparatus of the invention is a multi-function color copier in this embodiment, and the whole apparatus will be first described.

Figure 1:
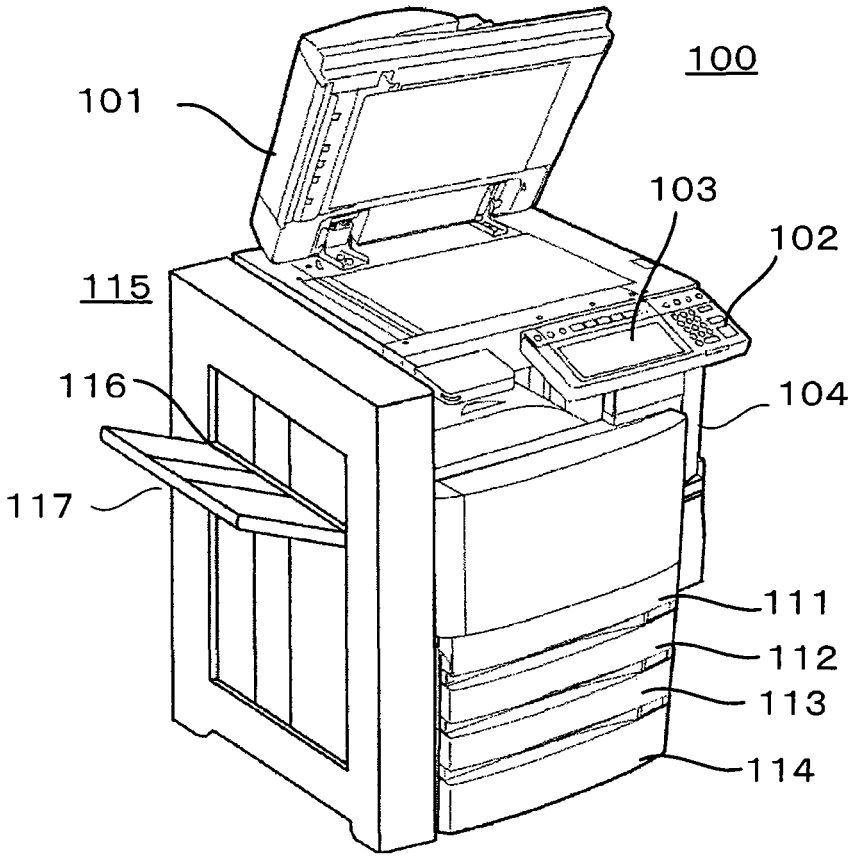
FIG. 1 is a perspective view showing a rough structure of a multi-function color copier (MFP) of an embodiment of the invention.

FIG. 1 is a perspective view showing an example of an outer appearance of the multi-function copier of the embodiment of the invention. An auto document feeder (ADF) 101 which automatically feeds a sheet-like document one by one and is used also as a document cover is openably and closably provided at an upper part of an apparatus main body 100. An operation panel 102 including various operation keys for instructing copy conditions and copy start, various indicators and the like is provided at an upper front part of the apparatus main body 100.

The operation panel 102 is also provided with various setting and registration buttons (not shown). A touch panel display 103 which displays various information to the user and can perform a specified input by user's touch when input is performed is provided at the side of the operation panel 102. A handle 104 to enable the inside to be opened is provided at the lower part of the operation panel 102 and on the front of the apparatus main body 100.

Paper feed cassettes 111, 112, 113 and 114 are attachably and detachably provided at the lower part of the apparatus main body 100. Sheets different in size and paper type are contained in the respective paper feed cassettes.

A finisher 115 contacts with the left side of the apparatus main body 100. In the apparatus main body 100, a latent image is formed as described later, and a printed and fixed sheet is subjected to a process, such as aligning or stapling, by the finisher 115, and is discharged from a sheet discharge port 116. The sheet discharged from the sheet discharge port 116 is stacked on a stack tray 117.

Figure 2:
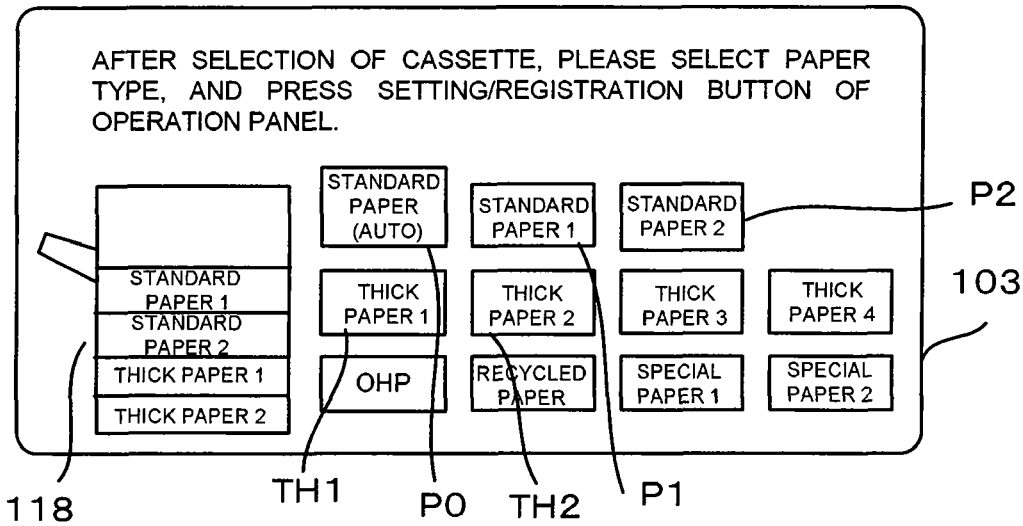
FIG. 2 is a view showing an example of a display screen of a touch panel display of an operation panel at the time of sheet type setting.

When the setting and registration button of the operation panel 102 is pressed, a general setting registration screen is first displayed on the touch panel display 103. When a sheet setting icon on this screen is touched, a sheet type setting screen illustrated in FIG. 2 is displayed. A main body side surface icon 118 is displayed on the left of the screen, buttons P0, P1 and P2 of standard paper (auto), standard paper 1 and standard paper 2 are arranged and displayed at the first stage on the right side, and buttons of four kinds of thick papers, that is, thick paper 1, thick paper 2, thick paper 3 and thick paper 4 are displayed at the second stage. Buttons corresponding to the types of sheets other than the standard paper and the thick paper are displayed at the third stage.

An indication "After selection of a cassette, please select a paper type and press the setting and registration button of the operation panel" is displayed on the display. In accordance with the guidance, the user touches a paper feed cassette of the main body side surface icon 118, and then touches a paper type icon displayed on the right side to select the paper type contained in the selected paper feed cassette. By this, the paper type is displayed at each paper feed cassette position of the main body side surface icon 118. By pressing the setting and registration button of the operation panel 102, a correspondence relation between the paper feed cassette and the paper type contained in this paper feed cassette is stored in an after-mentioned cassette sheet correspondence recognition section 122.

Figure 3:
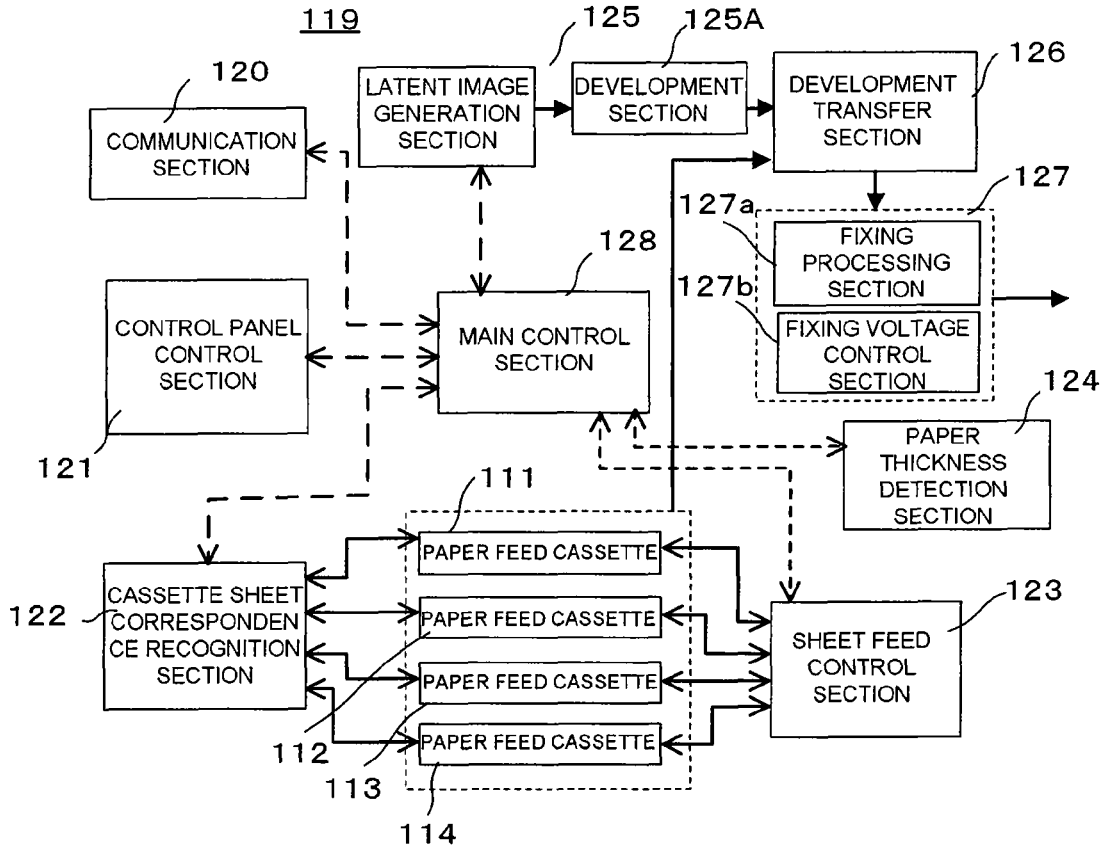
FIG. 3 is a view showing the whole electrical schematic structure of the embodiment.

FIG. 3 shows an electrical schematic structure of the embodiment shown in FIG. 1. An MFP 119 includes a communication section 120 connected to the outside through a network, a control panel control section 121 to control the whole control panel including the operation panel 102 and the touch panel display 103 shown in FIG. 1, the cassette sheet correspondence recognition section 122 to previously recognize the paper types contained in the paper feed cassettes 111, 112, 113 and 114, a sheet feed control section 123 to feed, according to the sheet type inputted to the touch panel display 103 as described in FIG. 2, the sheet of the type, a paper thickness detection section 124 to accurately detect the thickness of the sheet fed by the sheet feed control section 123, a latent image generation section 125 to scan an original document when copying or the like is performed in the MFP and to generate, for example, an electrostatic latent image, a development section 125A to develop the latent image generated by the latent image generation section 125 with, for example, toner, a development transfer section 126 to transfer the toner image to a specified sheet, a fixing section 127 to fix the transferred image by specified heat and pressure, and a main control section 128 to control the respective sections. The fixing section 127 includes a fixing processing section 127*a* to perform a fixing processing of an image to a specified sheet, and a fixing temperature control section 127*b* to control the fixing temperature when the fixing processing is performed.

Figure 4:
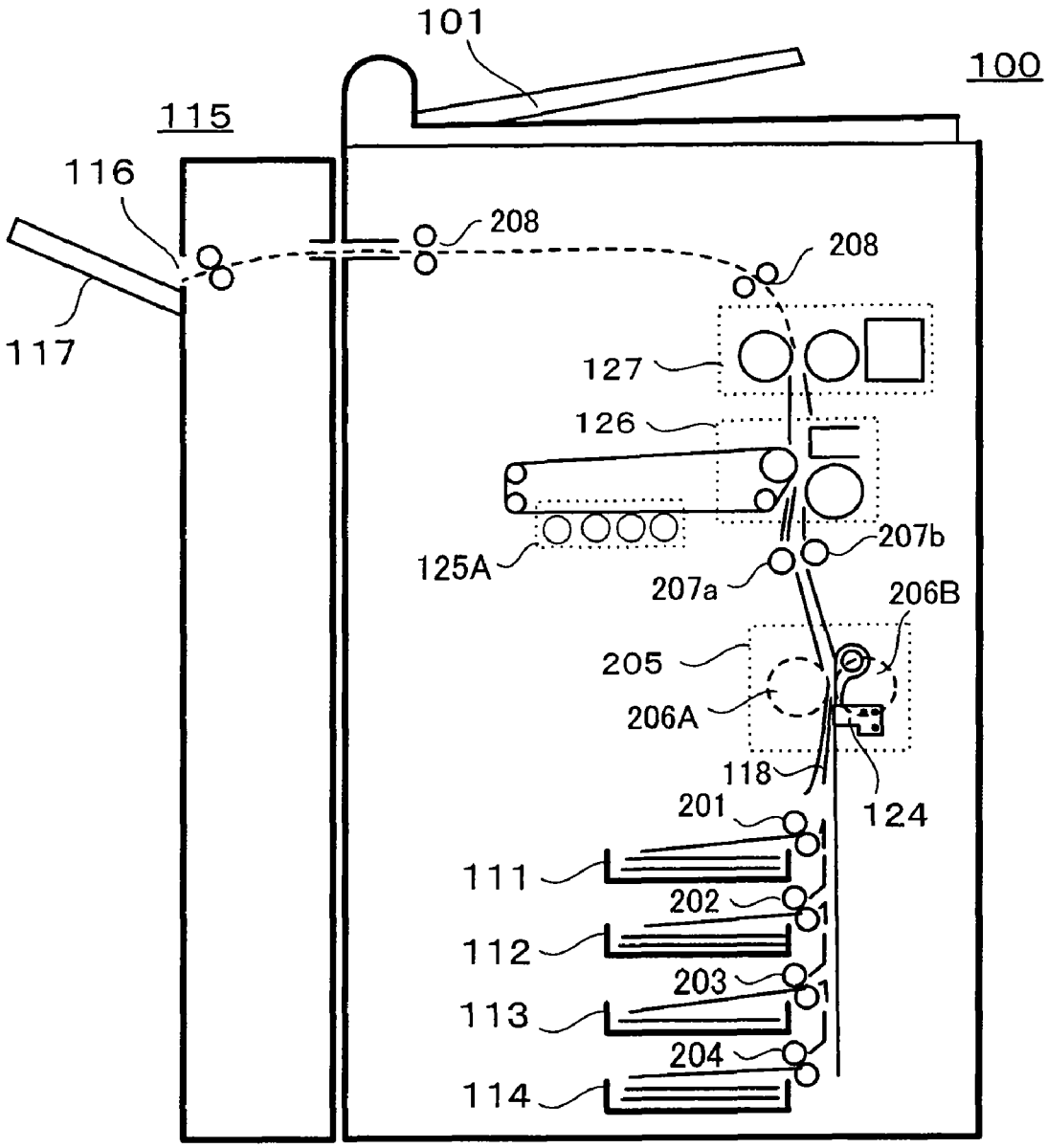
FIG. 4 is a schematic structural view showing a process in which a sheet is fed, is printed and is discharged in the MFP of the embodiment of the invention.

FIG. 4 shows a schematic structure of the MFP of the embodiment of the invention in which the flow of a sheet is mainly illustrated.

The paper feed cassettes 111, 112, 113 and 114 contain standard paper 1, standard paper 2, thick paper 1 and thick paper 2. The sheets contained in the paper feed cassettes are taken out one by one as required and selectively by paper feed rollers 201, 202, 203 and 204, and are fed to a paper thickness detection conveyance section 205. The sheet feed control section 123 shown in FIG. 3 includes a circuit to drive the paper feed rollers 201, 202, 203 and 204.

As described later, the paper thickness detection conveyance section 205 includes the paper thickness detection section 124 to detect the thickness of a conveyed sheet 118 and two pairs of conveyance rollers for conveying the sheet, that is, two conveyance drive rollers 206A and two conveyance driven rollers 206B. The sheet whose thickness is detected by the paper thickness detection section 124 of the paper thickness detection conveyance section 205 is conveyed and is aligned by a pair of register rollers 207*a* and 207*b*. The sheet aligned by the register rollers 207*a* and 207*b* is fed to the development transfer section 126. The electrostatic latent image generated in the latent image generation section 125 shown in FIG. 3 is developed with toner in the development section 125A, and is transferred to the conveyed sheet in the development transfer section 126.

The sheet on which the toner image is transferred is subjected to the fixing processing of the image in the fixing section 127, that is, printing is performed. There is a case where devices to perform the transfer and the fixing are collectively called a transfer and fixing device. Since the transfer is one method of image recording, there is also a case where they are collectively called a recording and fixing device.

The printed sheet is discharged from the apparatus main body 100 through some pairs of conveyance rollers 208, and enters the finisher 115. The sheet entering the finisher 115 is subjected to various finishing processes (not shown), such as stapling, in the finisher 115, is discharged from the sheet discharge port 116, and is stacked on the stack tray 117.

Figure 6:
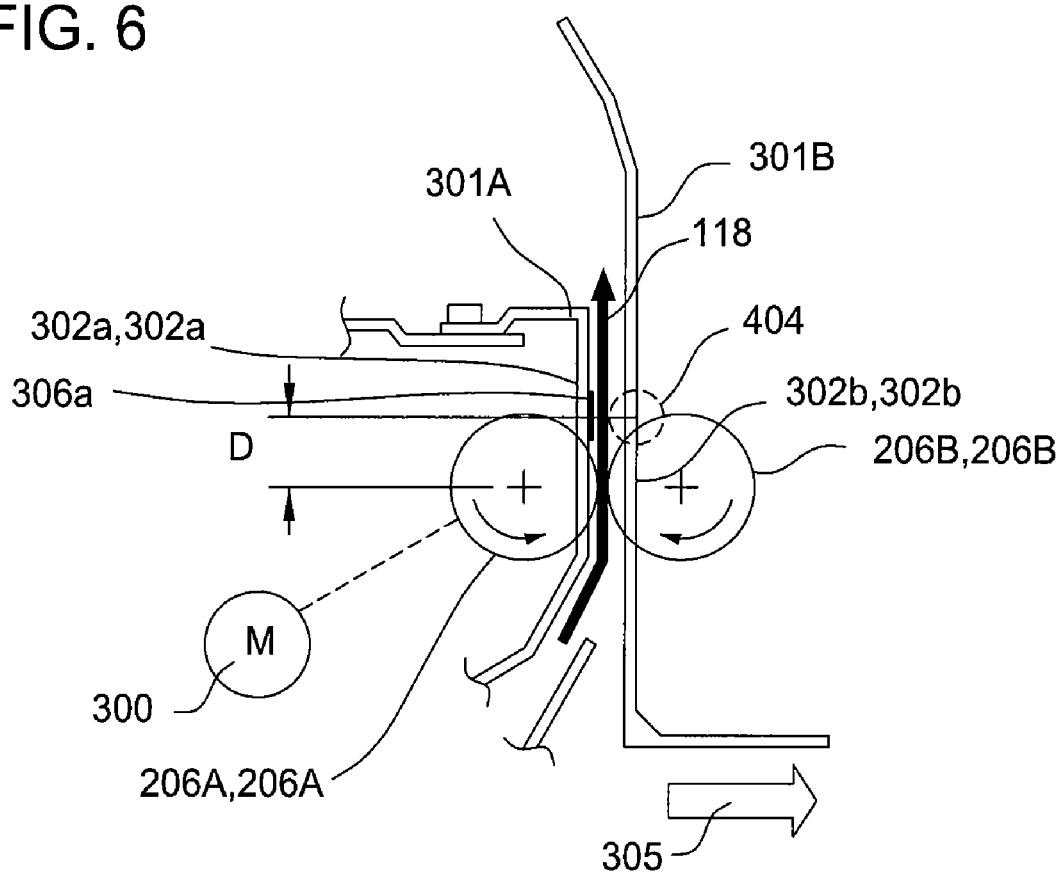
FIG. 6 is a view for explaining a relation between a conveyance drive mechanism and a paper thickness detection mechanism in this embodiment.

Here, a mechanism for automatically detecting the paper thickness by the paper thickness detection conveyance section 205 shown in FIG. 4 will be described. FIG. 6 shows a cross-sectional structure of the paper thickness detection conveyance section 205. The conveyance drive roller 206A is a roller at least the peripheral surface of which is made of, for example, rubber, and is rotated and driven by a conveyance drive motor 300. The peripheral surface of the conveyance driven roller 206B is made of, for example, plastic, contacts with the conveyance drive roller 206A, and is rotated in accordance with the rotation of the conveyance drive roller 206A.

Figure 7:
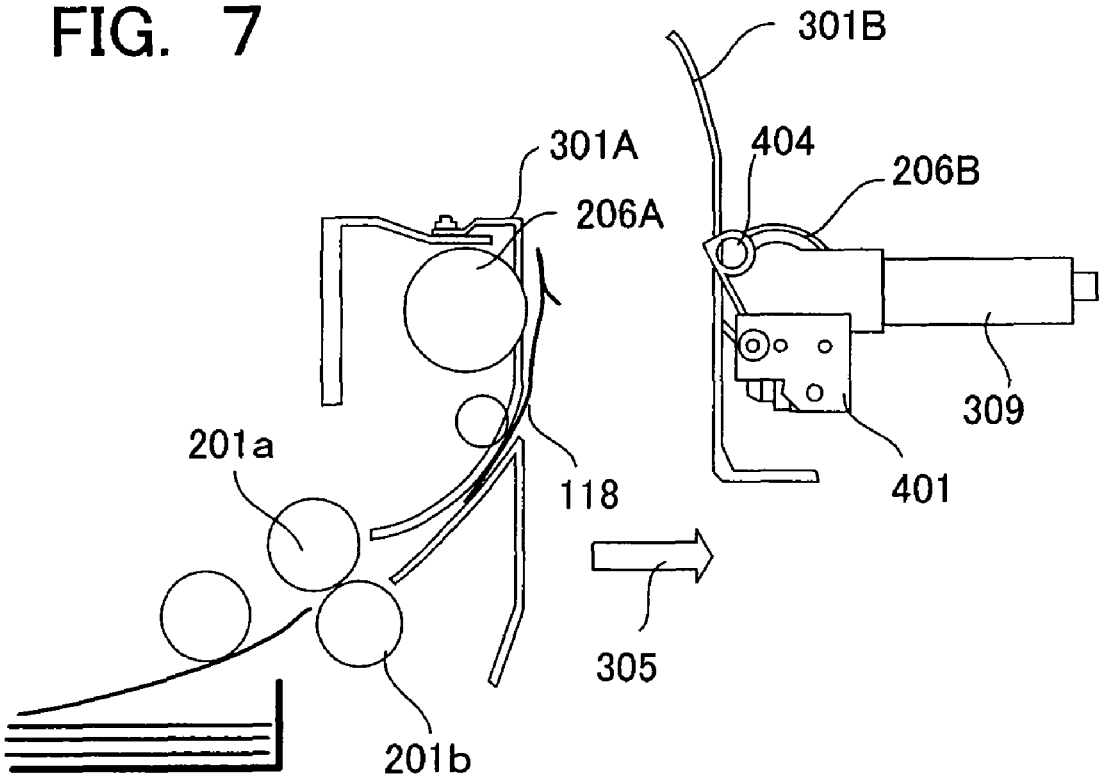
FIG. 7 is a view for explaining that two conveyance guides can be separated from each other in a lateral direction in this embodiment.

The sheet passes through between a conveyance guide 301A and a conveyance guide 301B. As shown in FIG. 6 and FIG. 7, roughly speaking, the conveyance guide 301A has an inverted C-shaped cross-section, and the conveyance guide 301B has an L-shaped cross-section. The sheet 118 is conveyed upward by the conveyance drive roller 206A and the conveyance driven roller 206B. The conveyance guide 301B is constructed to be movable in the lateral direction, that is, in the direction of an arrow 305, so that the conveyance guide can be easily removed when the sheet 118 is jammed in the middle of conveyance.

FIG. 7 is a sectional view of a state where the conveyance guide 301B and the conveyance driven rollers 206B and 206B are separated from the conveyance guide 301A and the conveyance drive rollers 206A and 206A. Further, FIG. 8 is a perspective view showing a state where the conveyance driven rollers 206B and 206B are separated from the conveyance guide 301B in the lateral direction.

The conveyance guide 301A is provided with openings 302*a*, and the conveyance guide 301B is provided with openings 302*b*. The conveyance drive roller 206A contacts with the conveyance driven roller 206B through the opening 302*a* and the opening 302*b*. When the sheet 118 is fed from the paper feed cassettes 111 to 114, the sheet is nipped between the conveyance drive roller 206A and the conveyance driven roller 206B and is conveyed in an arrow direction (upward). As described later, in the middle of the conveyance, the thickness of the sheet is detected by the paper thickness detection section 124.

Figure 8:
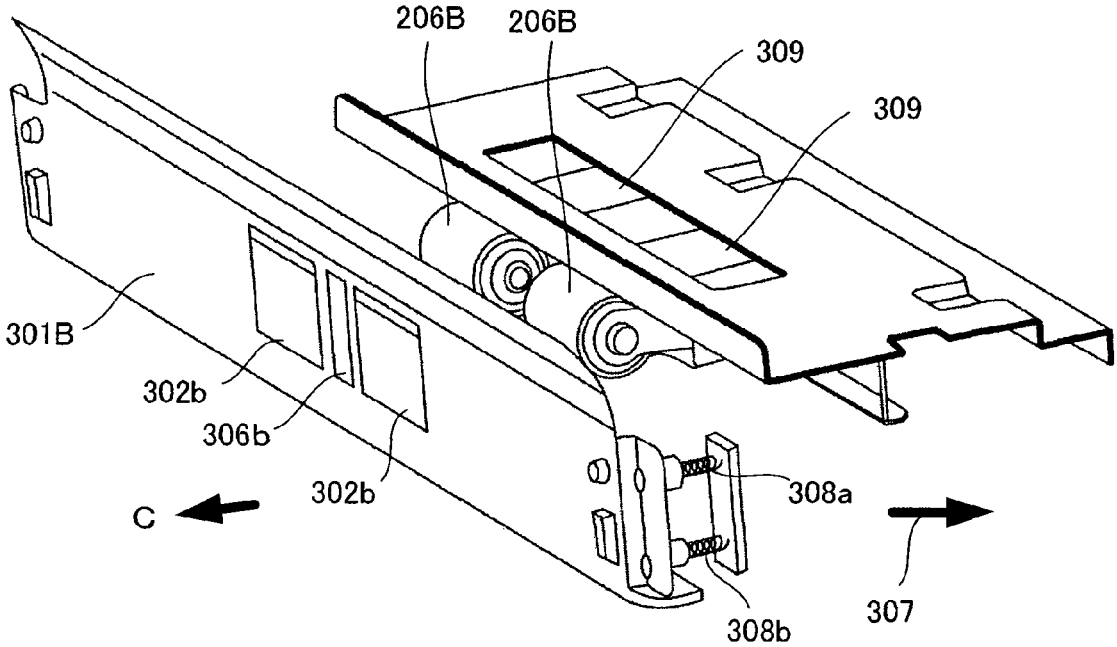
FIG. 8 is a view for explaining that a conveyance driven roller and the like can be further separated from the conveyance guide in this embodiment.

A center opening 306*b* provided between the two openings 302*b* and 302*b* of the conveyance guide 301B shown in FIG. 8 is an opening through which an after-mentioned bearing section 404 (shown in FIG. 10) of the paper thickness detection section 124 contacts with the sheet 118. A center protrusion 306*a* is provided on the conveyance guide 301A at a position corresponding to the center opening 306*b* of the conveyance guide 301B, and when the sheet 118 is conveyed, the bearing section 404 contacts with the sheet through the center opening 306*b* and measures its thickness.

As shown in FIG. 7, the conveyance guide 301B and the conveyance driven rollers 206B can be separated from the conveyance guide 301A and the conveyance drive rollers 206A. For example, when the sheet 118 is jammed in the vicinity of a space between the conveyance drive roller 206A and the conveyance driven roller 206B, the conveyance guides 301A and 301B are separated from each other as stated above, and the sheet can be removed.

Besides, as shown in FIG. 8, the conveyance guide 301B is attached to the main body by, for example, pressure springs 308*a* and 308*b*, and is pressed in an arrow C direction. On the other hand, the conveyance driven roller 206B and a holding mechanism 309 thereof are provided independently of the conveyance guide 301B and the like.

Figure 9:
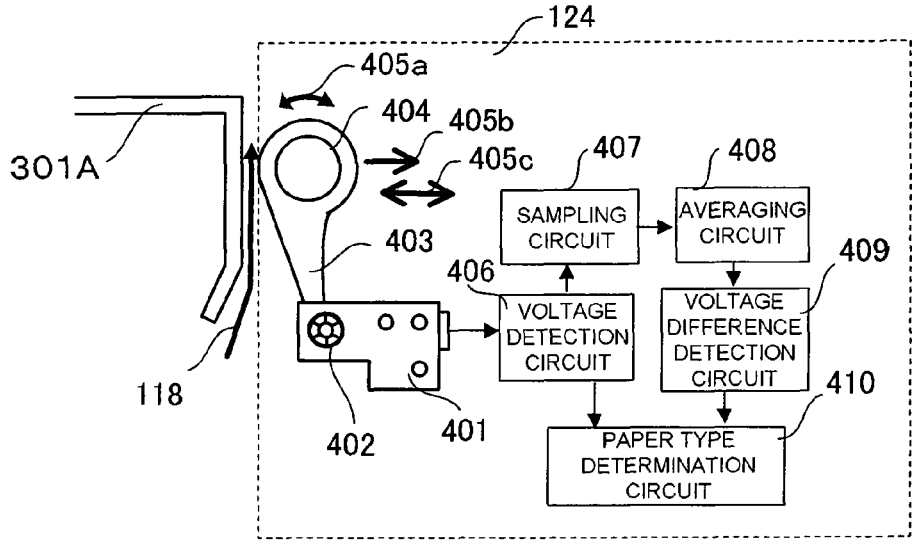
FIG. 9 is a view showing a structure of a paper thickness detection section in this embodiment.
Figure 10:
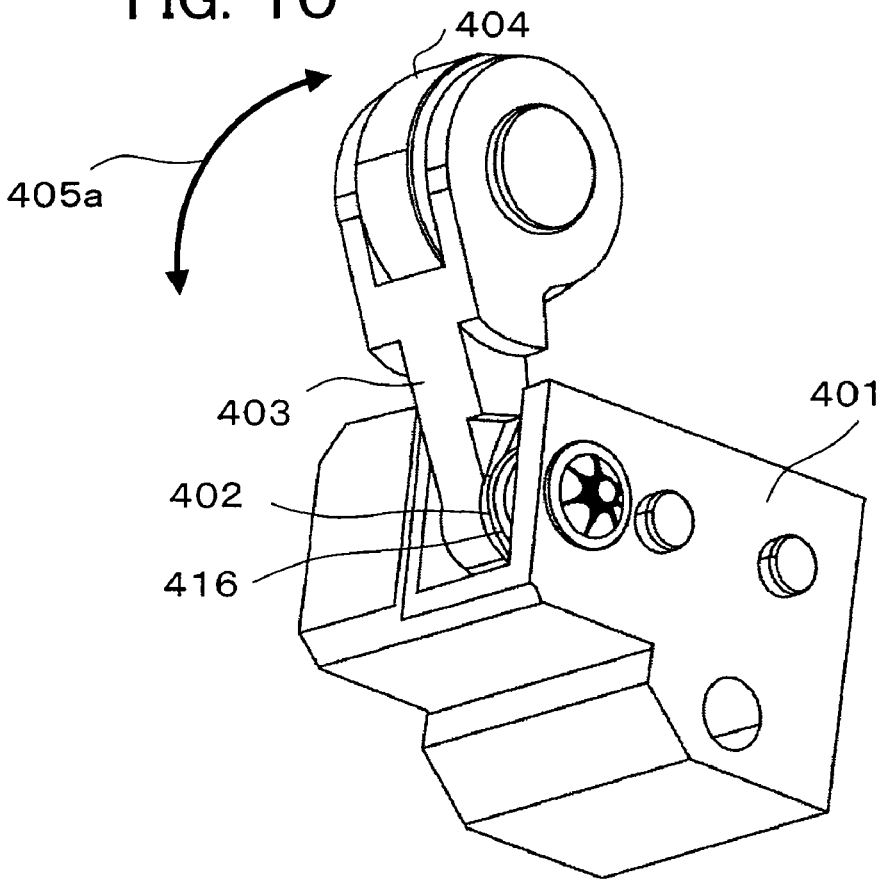
FIG. 10 is a perspective view showing a structure of a bearing section and the like in the paper thickness detection section 124.

FIG. 9 shows the whole structure of the paper thickness detection section 124. The paper thickness detection section 124 includes a resistance change detection module 401, an arm 403 which is turned around a fulcrum 402 of the resistance change detection module 401, the bearing section 404 provided at the tip of the arm 403, a voltage detection circuit 406, a sampling circuit 407, an averaging circuit 408, a voltage difference detection circuit 409 and a paper type determination circuit 410. FIG. 10 is a perspective view showing a structure of the resistance change detection module 401, the arm 403 and the bearing section 404. The bearing section 404 is rotated according to the movement of the sheet 118. Besides, the bearing section 404 is turned around the fulcrum 402 in a direction of an arrow 405*a* according to the thickness of the sheet 118.

Figure 12:
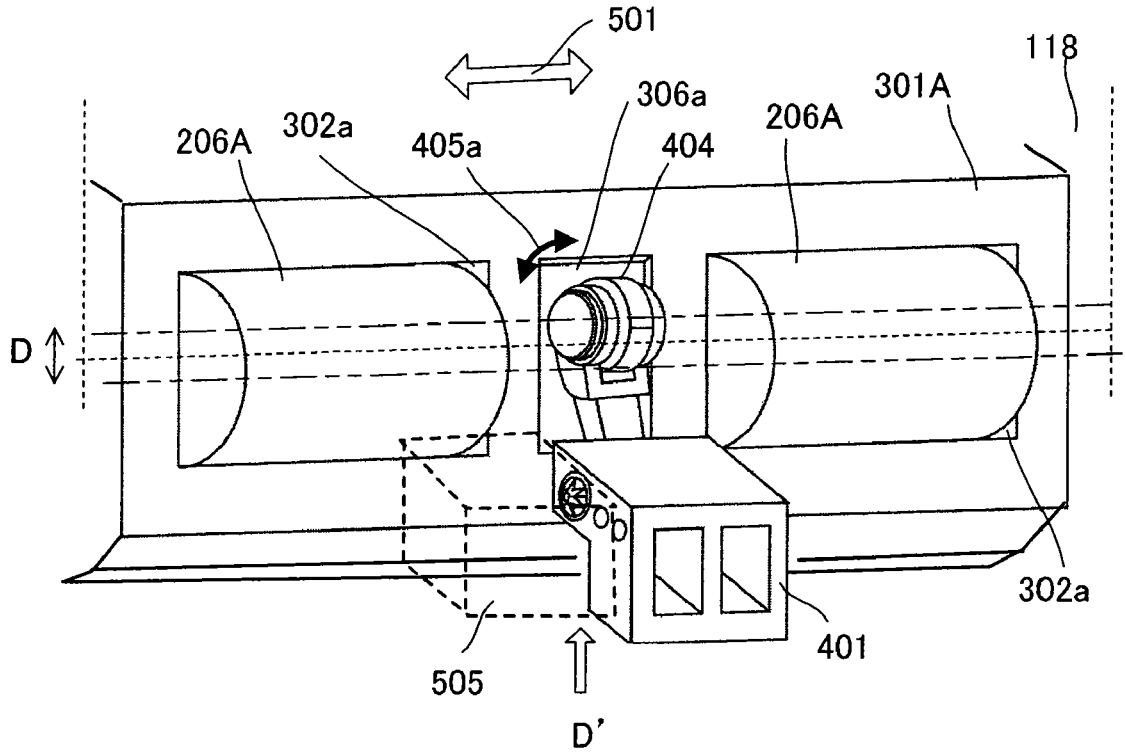
FIG. 12 is a view showing a relation among conveyance drive rollers, one of the conveyance guides, the bearing section and the like of the embodiment.
Figure 15:
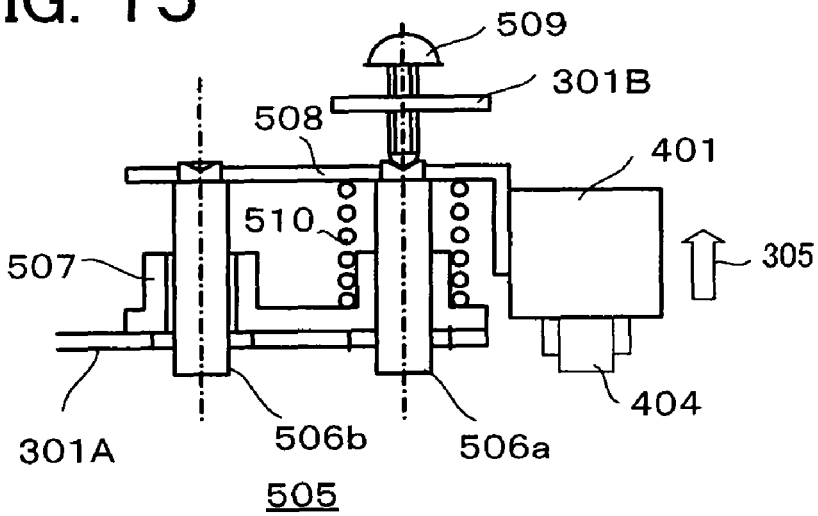
FIG. 15 is a view showing a resistance change detection module and a coupling state to a conveyance guide.

FIG. 12 shows a state in which part of the two conveyance drive rollers 206A provided to be spaced by a specified interval protrude through the openings 302*a* of the conveyance guide 301A, and the bearing section 404 contacts with the sheet 118 (indicated by a dotted line). This drawing is a drawing obtained when the left structure with respect to the sheet 118 in FIG. 6 is seen from the right. Incidentally, FIG. 15 is a drawing obtained when the resistance change detection module 401, the bearing section 404, and an attachment mechanism 505 (indicated by a dotted line) of the resistance change detection module 401 to the conveyance guide 301A in FIG. 12 are seen from an arrow D' direction.

At the center protrusion 306*a* of the conveyance guide 301A, the bearing section 404 is pressed at a specified pressure in the direction toward the conveyance guide 301A by a spring 416 or the like. A press load P thereof is, for example, 100 g. As shown in FIG. 6, a contact portion where the sheet 118 contacts with the bearing section 404 is provided downstream of a contact point between the conveyance drive roller 206A and the conveyance driven roller 206B.

When the press load P is made excessively large, when the sheet enters between the center protrusion 306*a* of the conveyance guide 301A and the bearing section 404, the sheet 118 is not smoothly conveyed and is buckled. When the press load P is excessively small, the bearing section 404 does not suitably contact with the sheet, and the bearing section 404 is liable to be separated from the sheet by vibration of the drive system. Besides, the bearing section 404 is separated from the sheet by shock when the sheet 118 enters. Accordingly, when the press load P is excessively small, it becomes difficult to measure the accurate thickness of the sheet.

A distance from the center point of the contact portion between the conveyance drive roller 206A and the conveyance driven roller 206B to the point where the bearing section 404 (in more detail, an after-mentioned outer ring 504) contacts with the sheet 118 is denoted by D.

When the distance D from the center point of the conveyance roller contact portion to the point where the bearing section contacts with the sheet is excessively large, the position where the bearing section 404 contacts with the sheet 118 becomes far from the position where the sheet 118 is conveyed and driven, that is, the contact position between the conveyance drive roller 206A and the conveyance driven roller 206B. Since the bearing section 404 does not have a function of conveying the sheet 118, at the position where the bearing section 404 contacts with the sheet 118 in such a state, the conveyance force of the sheet becomes low, and the normal conveyance of the sheet is liable to become difficult. As stated above, in general, there is a relation among the conveyance force of the sheet by the conveyance drive roller 206A and the conveyance driven roller 206B, the press load P of the bearing section 404, and the distance D.

Accordingly, although the press load P of the bearing section 404 varies according to the material and structure of the bearing, the conveyance force of the sheet and the like, the press load is generally preferably within a range of about 60 g to 140 g, and is more preferably within a range of about 80 g to 120 g.

Further, the present inventor found that the distance D between the roller contact point and the bearing contact point relates to the generation of an abnormal sound at the time of sheet alignment. Here, a description will be given to a finding that the abnormal sound becomes large when the distance D between the roller contact point and the bearing contact point becomes large, and a structure of shortening the distance D in order to suppress this kind of abnormal sound.

Figure 13:
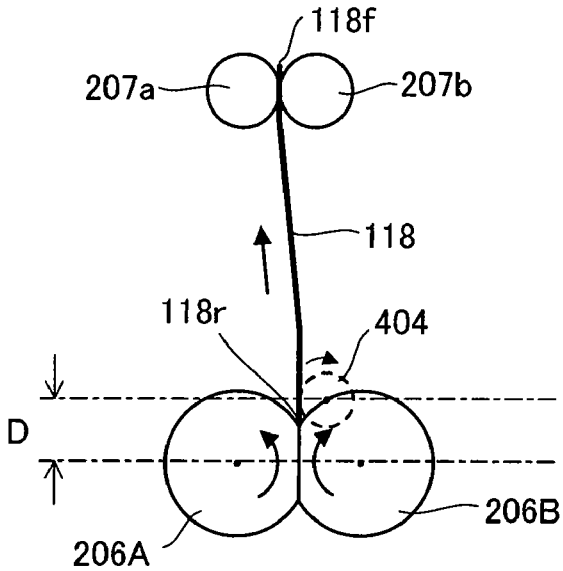
FIG. 13 is a view showing a relation among a pair of conveyance rollers, a pair of register rollers and a sheet positioned therebetween.

FIG. 13 shows a state where the sheet 118 is positioned between the contact portion of the conveyance drive roller 206A and the conveyance driven roller 206B and the contact portion of the pair of register rollers 207*a* and 207*b*. The conveyance driven roller 206B is rotated by the rotation of the conveyance drive roller 206A, and the sheet 118 nipped between these rollers is moved upward. When a leading edge 118*f* of the sheet 118 is nipped between the register rollers 207*a* and 207*b*, even if the sheet is skewed, the leading edge 118*f* of the sheet 118 is aligned in parallel to the axial direction of the register rollers 207*a* and 207*b*.

Thereafter, the sheet on the upstream side of the conveyance drive roller 206A and the conveyance driven roller 206B is stilled skewed, and at the instant when the sheet 118 comes off from between the conveyance drive roller 206A and the conveyance driven roller 206B, a trailing edge 118*r* of the sheet 118 is shifted in an axial direction (thrust direction: an arrow 501 direction of FIG. 12). At this time, sliding friction occurs between the bearing section 404 which contacts with the sheet 118 and the sheet, the bearing section 404 intermittently slips, the outer ring of the bearing section is vibrated, and the metallic coarse abnormal sound with a high pitch is liable to be generated.

As the distance D between the roller contact center point and the bearing section contact point becomes large, the abnormal sound is generated. The cause is as follows. When the distance D is large, much time is required until the trailing edge 118*r* of the sheet 118 is separated from the contact of the bearing section after the trailing edge is released from the conveyance drive roller 206A and the conveyance driven roller 206B. Accordingly, when the distance D is small, the sheet is immediately released from the bearing section 404 after it is released from both the rollers 206A and 206B, and the generation of the abnormal sound can be suppressed to the minimum.

From the viewpoint of preventing the generation of the abnormal sound, it is preferable that the distance is as small as possible, and is desirably 3 mm or less.

On the other hand, when this distance D becomes minus, that is, when the contact point between the bearing section 404 and the sheet 118 is disposed upstream of the contact point between the conveyance drive roller 206A and the conveyance driven roller 206B, the sheet 118 contacts with the bearing section before it is conveyed by these conveyance rollers, and there is a fear that sheet clogging such as a jam occurs. Accordingly, it is desirable that the distance D is 0 mm or more and about 3 mm or less.

Incidentally, when consideration is given to mechanical accuracy between the contact point of both the conveyance rollers 206A and 206B and the contact point of the bearing section 404 and the sheet 118, even if the distance D is theoretically designed to be 0 mm, there is a fear that the distance actually becomes minus. Thus, it is desirable that the distance D is not smaller than a distance of a mechanical accuracy allowable error, and specifically, the distance is more desirably about 1 mm or more and about 2 mm or less.

Next, in the embodiment of the invention, a description will be given to a structure of reducing the frequency of an abnormal sound so that the coarse abnormal sound is made not coarse.

The metallic abnormal sound with a high frequency due to the sliding friction between the sheet and the bearing is caused by the vibration of the bearing in the lateral direction. Then, the inventor found that when the bearing section 404 having a large outer diameter is used, the frequency of the abnormal sound can be reduced.

Figure 14:
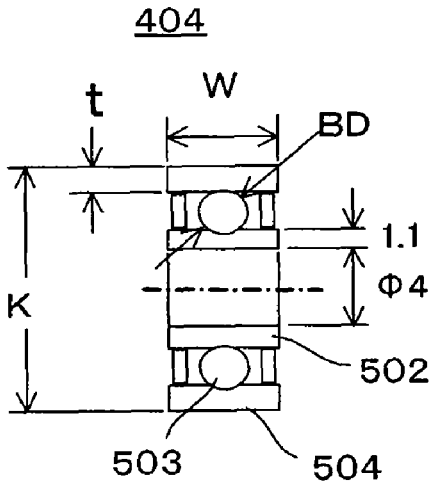
FIG. 14 is a sectional view of the bearing section of the embodiment.

FIG. 14 shows an example of cross-sectional sizes of the bearing section 404. The bearing section 404 includes an inner ring 502, a plurality of metal ball bearings 503 provided to be rotatable around this inner ring, and an outer ring 504 provided outside these ball bearings. The bearing section 404 is made such that an outer diameter K of the outer ring 504 is 12 mm, a width W thereof is 4 mm, a thickness t thereof is 1.5 mm, and a diameter BD of the ball bearing 503 is 2.00 mm. The frequency of the abnormal sound is compared between a case where the large bearing section as stated above is used and a case where a small bearing section is used.

The small bearing section used for the comparison is made such that the outer diameter K of the outer ring 504 is 8.00 mm, the width W thereof is 3 mm, the thickness t thereof is 0.65 mm, and the diameter BD of the ball bearing 503 is 1.2 mm.

As a result, it is confirmed that the frequency of the abnormal sound becomes lower in the case where the large bearing section is used than in the case where the small bearing section is used. As a result of checking the bearing sections with various sizes, it is found that as the thickness of the outer ring 504 becomes large, the frequency of the abnormal sound becomes low. Actually, it is necessary to take balance in life and strength of the bearing section. Thus, the thickness of only the outer ring 504 is not made large, but the outer diameter of the bearing section is made large to increase the thickness.

As a result of experiments, when the thickness of the outer ring 504 of the bearing section is made about 1 mm or more, the frequency of the abnormal sound is reduced, and the generation of the coarse abnormal sound can be suppressed. When the thickness of the outer ring 504 is made thick, the outer diameter of the bearing section becomes large, and therefore, the thickness has naturally a limit. It is desirable that the thickness of the outer ring is about 1 mm or more and 3 mm or less.

FIG. 15 shows the fixing mechanism 505 of the resistance change detection module 401 to the conveyance guide 301A when seen in the D' direction in FIG. 12.

The fixing mechanism 505 includes two studs 506*a* and 506*b* fixed to a bracket 508, a holder 507 to hold the studs 506*a* and 506*b*, the bracket 508 to hold the resistance change detection module 401 and to hold the ends of the studs 506*a* and 506*b*, an adjustment screw 509 pressed to the end of the bracket 508 through the conveyance guide 301B, and a press spring 510 placed between the holder 507 and the bracket 508 to surround the stud 506*a*.

The ends of the studs 506*a* 506*b* fixed to the bracket 508 are recesses (countersinking shape). The tip of the adjustment screw 509 is round and contacts with the recess.

Since the position of the conveyance guide 301B is constant, when the adjustment screw 509 is rotated and is thrust downward, the bracket 508 is depressed downward against the press spring 510. In this way, the position of the resistance change detection module 401 is moved in the direction opposite to the arrow 305. In this way, the distance between the resistance change detection module 401 and the center protrusion 306*a* of the conveyance guide 301A can be adjusted.

Figure 16:
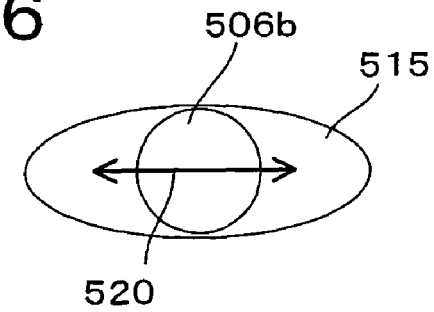
FIG. 16 is a view showing a relation between a long hole of a holder and a stud.

The stud 506*b* is coupled through the holder 507 having a long hole 515 as shown in FIG. 16. Accordingly, the stud 506*b* can move in a direction of an arrow 520.

The reason why the hole 515 in which the stud 506*b* is inserted is the long hole is that even if the distance and the degree of parallelization between the stud 506*a* and the stud 506*b* are not satisfactory, these can be made satisfactory.

Figure 5:
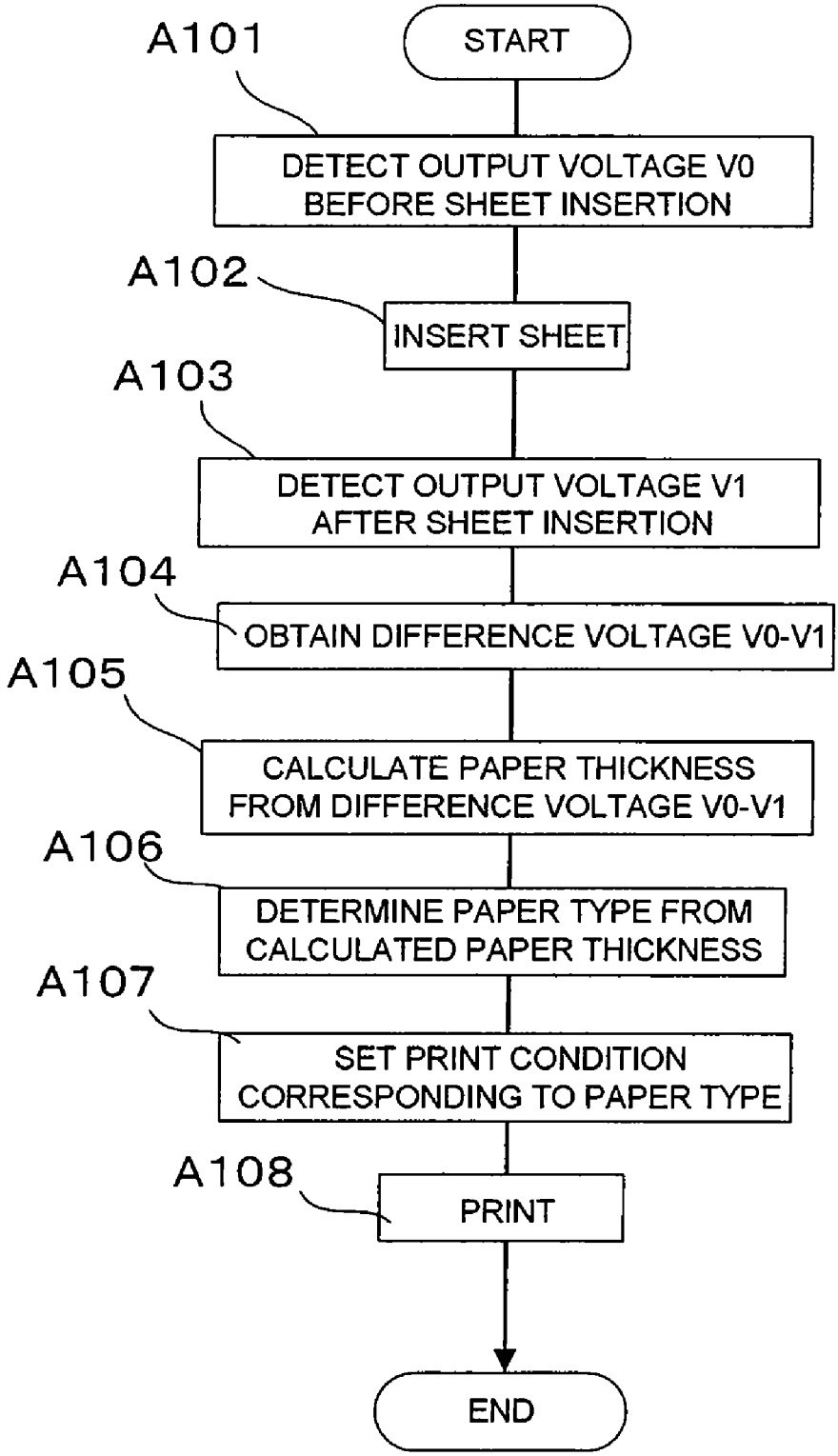
FIG. 5 is a view showing a flowchart for explaining an operation of the MFP of the embodiment of the invention.

Next, return is made to the paper thickness detection section 124 shown in FIG. 9, and the contrivance to detect the thickness of the sheet will be described. FIG. 5 is a flowchart for explaining the operation of detecting the thickness of the sheet.

When the sheet 118 is conveyed along the conveyance guide 301A, the bearing section 404 rotates in the clockwise direction of an arrow 405*a*, and the arm 403 is shifted by the thickness of the sheet 118, that is, is turned slightly in the direction of an arrow 405*b*. A magnet is provided near the fulcrum of the arm 403. A magnetic resistance sensor using a magnetic resistance whose resistance value is changed correspondingly to the change of a magnetic field is provided near the magnet.

An electric signal output of the magnetic resistance sensor is inputted to the voltage detection circuit 406, and its output voltage is sampled, for example, ten times by the sampling circuit 407. The reason why sampling is performed to average those values is that the bearing section 404 reciprocates in the direction of an arrow 405*c* by the vibration of the apparatus and the conveyance of the sheet, so that the value of the magnetic resistance is changed, and the output voltage of the voltage detection circuit 406 is changed.

The voltage values sampled by the sampling circuit 407 are averaged by the averaging circuit 408, and are inputted to the voltage difference detection circuit 409. The voltage difference detection circuit 409 detects the difference between the averaged voltage values. The voltage difference corresponds to the thickness of the sheet 118. The magnetic resistance of the magnetic resistance sensor functions in a direction in which the resistance value increases when the sheet is conveyed, and the output voltage value of the voltage detection circuit 406 is decreased. Incidentally, when the sheet is conveyed, the resistance value of the magnetic resistance may be decreased, and the output voltage value of the voltage detection circuit may be increased.

When the voltage value detected by the voltage detection circuit 406 is set to, for example, 1 mV for a sheet thickness of 1 μm, in general, since the thickness of the standard paper is about 100 μm, the standard paper is detected to have a voltage value of about 100 mV. For example, a voltage V0 before the sheet passes is made 3.3 V, and when the thickness of the paper is thick, the voltage value is changed in the direction in which the voltage value is decreased while the center of the value is about 1.35 V.

Figure 11:
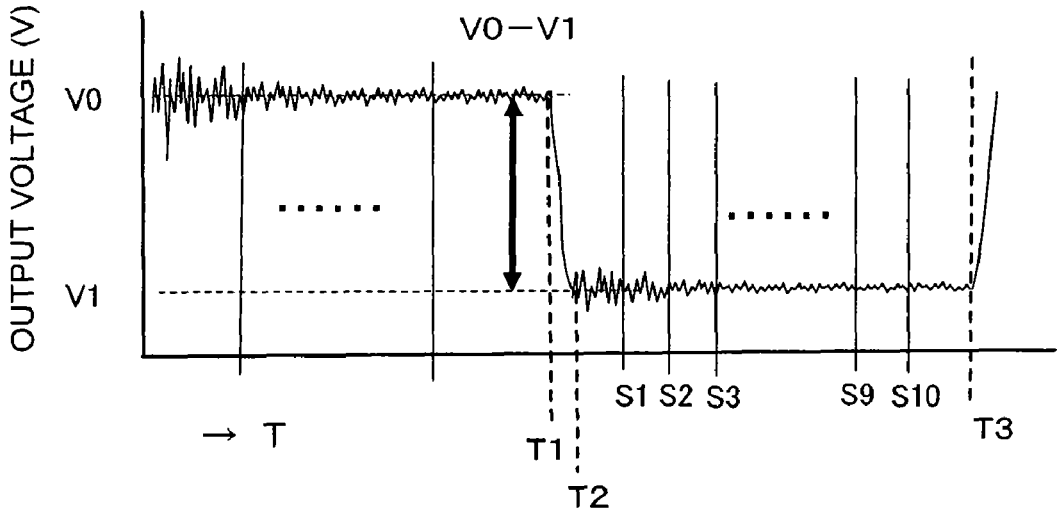
FIG. 11 is a view showing an example of an output voltage of a voltage detection circuit when a sheet enters the paper thickness detection section.

For example, it is assumed that the sheet 118 contacts with the bearing section 404 at time T1 to T2, and the sheet is conveyed and returned to the original state at time T3. As shown in FIG. 11, when there is no sheet 118, the voltage detection circuit 406 outputs a voltage of about V0. Also in this state, the output value fluctuates by the vibration of the apparatus. The fluctuating output voltage value is sampled by the sampling circuit 407, and the sampled values are averaged by the averaging circuit 408.

The averaged voltage value is sent to the voltage difference detection circuit 409, and V0 is once stored as the voltage value when the sheet is not conveyed (Act A101).

At time T1, the sheet 118 is conveyed and is nipped between the bearing section 404 and the conveyance guide 301A, and the bearing section 404 is rotated as indicated by the arrow 405*a* and is turned as indicated by the arrow 405*b*. At this time, the value of the magnetic resistance in the magnetic resistance sensor is increased, and after time T2, the output value of the voltage detection circuit 406 becomes lower than V0 as shown in FIG. 11. The sheet 118 is inserted (Act A102).

Also in the state where the sheet 118 is nipped between the bearing section 404 and the conveyance guide 301A and is moved, the bearing section 404 is moved by the movement of the sheet 118 and the vibration of the apparatus. The output voltage value of the voltage detection circuit 406 fluctuates by the movement of the bearing section 404. These voltage values are sampled, for example, ten times by the sampling circuit 407, the sampled values are averaged by the averaging circuit 408, and the average value is measured as a voltage value V1 in the state where the sheet 118 is inserted (Act A103). The voltage value V1 is inputted to the voltage difference detection circuit 409. The voltage difference detection circuit 409 outputs a value (V0−V1) obtained by subtracting the voltage value V1 from the previously detected voltage value V0 as a voltage difference (Act A104).

The voltage difference (V0−V1) corresponds to the thickness of the sheet 118, and the thickness of the sheet 118 is calculated (Act A105). As stated above, when the paper thickness is detected as the difference between the voltage values, not the voltage value itself, the offset of the voltage can be cancelled. Besides, such a problem disappears that the voltage value is changed by the distortion of the conveyance guide or the like. Accordingly, there is a merit that the paper thickness can be further accurately measured. In this embodiment, the voltage values are measured a plurality of times before the sheet 118 contacts with the bearing section 404 and after the contact, and those average values are calculated. By doing so, the voltage value with high accuracy can be obtained.

However, the measurement may be performed a plurality of times only for one of the cases before the contact and after the contact and the average value may be obtained. Besides, the average value is not obtained, but the voltage value can be measured only once. Especially, when the voltage measurement after the bearing section 404 contacts with the sheet 118 is performed one time, there is a merit that the paper thickness can be quickly detected.

At next Act A106, the paper type determination circuit 410 determines the paper type from the thickness of the sheet 118 calculated by the voltage difference detection circuit 409 at Act A105. At Act A107, the print condition is set according to the paper type. For example, in the fixing voltage control section 127*b* of the fixing section 127 shown in FIG. 3, the fixing temperature is changed by changing the fixing voltage. For example, when the paper type is standard paper 2 thicker than standard paper 1, the fixing voltage is made high, and the fixing temperature is made high.

As stated above, the paper thickness detection section 124 measures the voltage when the sheet 118 passes, obtains the voltage difference from the voltages before and after that, obtains the paper thickness, and determines the paper type from the paper thickness.

According to the embodiment, since the bearing section 404 which is provided downstream of the pairs of conveyance rollers 206A and 206B and contacts with the sheet exists near the conveyance rollers 206A and 206B, the abnormal sound generated by the slip between the sheet 118 and the outer ring 504 of the bearing section 404 can be suppressed.

Besides, when the outer ring 504 of the bearing section 404 is large, the frequency of the abnormal sound can be reduced, and the generation of the coarse sound can be suppressed.

In the embodiment, the description is given to the case where the invention is applied to the multi-function color copier. However, the invention can also be applied to another image forming apparatus which includes an image generation section to generate an image to be printed on a recording sheet and specifies a paper type for printing, such as a normal copier, a printer or a facsimile, in addition to the multi-function color copier.

In the embodiment of the invention, the paper thickness is detected in such a way that the turning amount of the bearing section is detected as the change of the voltage value due to the change of the magnetic resistance. However, in the invention, the turning amount of the bearing section can be detected by another electric method. Further, the turning amount can be detected by, for example, an optical method or a mechanical method in addition to the electric method.

Besides, in the embodiment of the invention, the description is given to the case where after a toner image is obtained, the toner image is transferred. However, the invention can also be applied to the case where the toner image is not transferred, but the toner image is formed and fixed on the sheet.

Obviously, many modifications and variations of this invention are possible in the light of the above teachings. It is therefore to be understood that within the scope of the appended claims, this invention may be practiced otherwise than as specification.

What is claimed is:

1. An image forming apparatus comprising:

a pair of conveyance rollers to nip and convey a sheet;

a turning amount detection section which includes a bearing section coming in contact with the sheet downstream of the pair of conveyance rollers, a distance from a center point of a contact portion of the pair of conveyance rollers to a point where a bearing section contact the sheet is 3 mm or less;

a thickness detection section to detect a thickness of the sheet based on a turning amount detected by the turning amount detection section;

a pair of register rollers which is disposed downstream of the bearing section and aligns the sheet; and an image recording section to record the image on the sheet passing through the pair of register rollers, wherein the turning amount detection section includes:

the bearing section including a shaft, an inner ring fitted to the shaft, an outer ring disposed coaxially with the inner ring, and a plurality of ball bearings provided between the outer ring and the inner ring;

an arm section turned by the thickness of the sheet brought into contact with the bearing section; and an electric turning amount detection section to electrically detect the turning amount of the arm section.

2. The apparatus of claim 1, wherein the electric turning amount detection section measures the turning amount as a voltage value generated by turning of the bearing section.

3. The apparatus of claim 2, wherein the electric turning amount detection section obtains a difference between a voltage value measured before the sheet reaches the bearing section and a voltage value measured after the sheet reaches the bearing section, and detects the paper thickness of the sheet corresponding to the voltage difference.

4. The apparatus of claim 3, wherein the distance from the center point of the contact portion of the pair of conveyance rollers to the point where the bearing section contacts the sheet is a mechanical accuracy allowable error of about 3 mm or less.

5. The apparatus of claim 4, wherein the distance from the center point of the contact portion of the pair of conveyance rollers to the point where the bearing section contacts the sheet is about 1 mm to about 2 mm.

6. The apparatus of claim 1, wherein the image recording section includes a fixing section.

7. An image forming apparatus comprising:

a pair of conveyance rollers to nip and convey a sheet;

a turning amount detection section which includes a bearing section coming in contact with the sheet downstream of the of the pair of conveyance rollers when the sheet is conveyed;

a thickness detection section to detect a thickness of the sheet based on a turning amount detected by the turning amount detection section;

a pair of register rollers which is disposed downstream of the bearing section and aligns the sheet; and an image recording and fixing section to record and fix the image on the sheet passing through the pair of register rollers, wherein the turning amount detection section includes:

the bearing section including a shaft, an inner ring fitted to the shaft, an outer ring disposed coaxially with the inner ring, and a plurality of ball bearings provided between the outer ring and the inner ring;

an arm section turned by the thickness of the sheet brought into contact with the bearing section; and an electric turning amount detection section to electrically detect the turning amount of the arm section wherein the thickness detection section detects the thickness of the sheet from the turning amount detected by the electric turning amount detection section, and a distance from a center point of a contact portion of the pair of conveyance rollers to a point where the outer ring contacts the sheet is a mechanical accuracy allowable error of 3 mm or less.

8. The apparatus of claim 7, wherein an outer diameter of the bearing section is larger than a normal one.

9. The apparatus of claim 8, wherein a thickness of the outer ring is about 1 mm to about 3 mm.

10. The apparatus of claim 9, wherein the distance from the center point of the contact portion of the pair of conveyance rollers to the point where the outer ring contacts the sheet is about 1 mm to about 2 mm.

11. The apparatus of claim 10, wherein the electric turning amount detection section measures the turning amount as a voltage value generated by turning of the bearing section.

12. The apparatus of claim 11, wherein the electric turning amount detection section obtains a difference between a voltage value measured before the sheet reaches the bearing section and a voltage value measured after the sheet reaches the bearing section, and detects the paper thickness of the sheet corresponding to the voltage difference.

13. An image forming apparatus comprising:

a pair of conveyance rollers to nip and convey a sheet;

a turning amount detection section which includes a bearing section coming in contact with the sheet downstream of the pair of conveyance rollers when the sheet is conveyed;

a pair of conveyance guides which are provided at both sides of the sheet to guide the sheet, each of which has a through hole through which the pair of conveyance rollers contact with each other, one conveyance guide having a through hole through which the bearing section contacts the sheet, and the other conveyance guide having a protrusion;

a thickness detection section to detect a thickness of the sheet based on a turning amount detected by the turning amount detection section;

a pair of register rollers which is disposed downstream of the bearing section and aligns the sheet; and an image recording and fixing section to record and fix the image on the sheet passing through the pair of register rollers, wherein the turning amount detection section includes:

the bearing section including a shaft, an inner ring fitted to the shaft, an outer ring disposed coaxially with the inner ring, and a plurality of ball bearings provided between the outer ring and the inner ring;

an arm section turned by the thickness of the sheet brought into contact with the bearing section; and an electric turning amount detection section to electrically detect the turning amount of the arm section wherein the thickness detection section detects the thickness of the sheet from the turning amount detected by the electric turning amount detection section, and a distance from a center point of a contact portion of the pair of conveyance rollers and a point where the outer ring contacts the sheet is a mechanical accuracy allowable of 3 mm or less.

14. The apparatus of claim 13, wherein an outer diameter of the bearing section is larger than a normal one.

15. The apparatus of claim 14, wherein a thickness of the outer ring is about 1 mm to about 3 mm.

16. The apparatus of claim 15, wherein the distance from the center point of the contact portion of the pair of conveyance rollers to the point where the outer ring contacts the sheet is about 1 mm to about 2 mm.

17. The apparatus of claim 16, wherein the electric turning amount detection section measures the turning amount as a voltage value generated by turning of the bearing section.

18. The apparatus of claim 17, wherein the electric turning amount detection section obtains a difference between a voltage value measured before the sheet reaches the bearing section and a voltage value measured after the sheet reaches the bearing section, and detects the paper thickness of the sheet corresponding to the voltage difference.

19. The apparatus of claim 18, wherein at least one of the voltage value measured before the sheet reaches the bearing section and the voltage value measured after the sheet reaches the bearing section is an average value of values measured a plurality of times.

* * * * *